US005255749A

United States Patent [19]

Bumpurs et al.

[11] Patent Number: 5,255,749

[45] Date of Patent: Oct. 26, 1993

[54] STEERABLE BURROWING MOLE

[75] Inventors: Carl J. Bumpurs; C. Gordan Baker, both of Racine, Wis.

[73] Assignee: Steer-Rite, Ltd., Racine, Wis.

[21] Appl. No.: 851,821

[22] Filed: Mar. 16, 1992

[51] Int. Cl.[5] ..... E21B 7/08

[52] U.S. Cl. ..... 175/26; 175/73

[58] Field of Search ..... 175/19, 26, 61, 62, 175/73, 94

[56] References Cited

U.S. PATENT DOCUMENTS

| | | | |
|---|---|---|---|
| 3,525,405 | 8/1970 | Coyne et al. | 175/19 |
| 3,554,302 | 1/1971 | Adkins et al. | 175/26 |
| 3,589,454 | 6/1971 | Coyne | 175/26 |
| 3,630,295 | 12/1971 | Coyne | 175/73 |
| 3,712,391 | 1/1973 | Coyne | 175/26 |
| 3,730,283 | 5/1973 | Kostylev et al. | 175/53 |
| 3,794,128 | 2/1974 | Gagen et al. | 175/73 |
| 3,952,813 | 4/1976 | Chepurnoi et al. | 173/91 |
| 4,026,371 | 5/1977 | Takada | 175/45 |
| 4,108,256 | 8/1978 | Moore | 175/61 |
| 4,416,339 | 11/1983 | Baker et al. | 175/73 X |
| 4,438,820 | 3/1984 | Gibson | 175/73 X |
| 4,592,432 | 6/1986 | Williams et al. | 175/26 |
| 4,596,292 | 6/1986 | Crover | 175/19 |
| 4,621,698 | 11/1986 | Pittard et al. | 175/305 |
| 4,632,191 | 12/1986 | McDonald et al. | 175/19 |
| 4,646,277 | 2/1987 | Bridges et al. | 367/191 |
| 4,662,457 | 5/1987 | Bouplon | 173/91 |
| 4,694,913 | 9/1987 | McDonald et al. | 175/61 |
| 4,708,211 | 11/1987 | Shemyakin et al. | 175/19 |
| 4,787,463 | 11/1988 | Geller et al. | 175/45 |
| 4,809,789 | 3/1989 | MacFarlane | 173/91 |
| 4,834,193 | 5/1989 | Leitko, Jr. et al. | 175/19 |
| 4,858,703 | 8/1989 | Kinnan | 175/19 |
| 4,858,704 | 8/1989 | McDonald et al. | 175/61 |
| 4,907,658 | 3/1990 | Stangl et al. | 175/19 |
| 4,921,055 | 5/1990 | Kayes | 175/45 |
| 4,928,775 | 5/1990 | Lee | 175/19 |
| 4,938,297 | 7/1990 | Schmidt | 175/19 |
| 4,958,689 | 9/1990 | Lee | 175/19 |
| 5,002,137 | 3/1991 | Dickinson | 175/19 |
| 5,002,138 | 3/1991 | Smet | 175/45 |
| 5,010,965 | 4/1991 | Schmelzer | 175/19 |
| 5,031,706 | 7/1991 | Spektor | 175/19 |
| 5,050,686 | 9/1991 | Jenne | 173/91 |
| 5,056,608 | 10/1991 | Hemmings | 175/19 |
| 5,101,912 | 4/1992 | Smet | 175/26 |

FOREIGN PATENT DOCUMENTS

| | | | |
|---|---|---|---|
| 961479 | 1/1975 | Canada | 175/73 |

*Primary Examiner*—William P. Neuder

*Attorney, Agent, or Firm*—Jansson & Shupe, Ltd.

[57] ABSTRACT

A steerable burrowing mole including a forward steering unit with an axial main portion, adjustable fins, and apparatus to adjust the fins between first and second angular orientations, the first for inducing mole rotation and the second for inducing movement toward a first radial direction. The earth-penetrating tip is preferably beveled surface to provide maximum turning force toward the first radial direction. One of the fins is in an orientation for inducing slight corrective reverse rotation. An adaptor for converting a basic burrowing mole into a steerable mole as described.

35 Claims, 5 Drawing Sheets

STEERABLE BURROWING MOLE

FIELD OF THE INVENTION

This invention is related generally to the field of earth-burrowing devices, often referred to as "moles," and, more particularly, to steerable burrowing devices.

BACKGROUND OF THE INVENTION

Much effort has been applied during the last twenty years or so in improvement of earth-burrowing devices. Development efforts have accelerated because of the high demand for equipment to bore underground passages without disturbing the ground surface (e.g., roadways). Some of the early work in this field included work by Bell Labs and Schramm Company's "Pneumagopher." More recently, innovations have been made by a number of companies.

Among the many U.S. Pat. Nos. relating to earth-burrowing moles are the following:

3,630,295 (Coyne et al.)
3,794,128 (Gagen et al.)
3,952,813 (Chepurnoi et al.)
4,026,371 (Takada et al.)
4,108,256 (Moore, III)
4,592,432 (Williams et al.)
4,596,292 (Crover)
4,621,698 (Pittard et al.)
4,632,191 (McDonald et al.)
4,646,277 (Bridges et al.)
4,662,457 (Bouplon)
4,694,913 (McDonald et al.)
4,708,211 (Shemyakin et al.)
4,787,463 (Geller et al.)
4,809,789 (MacFarlane)
4,834,193 (Leitko, Jr. et al.)
4,858,703 (Kinnan)
4,858,704 (McDonald et al.)
4,907,658 (Stangl et al.)
4,921,055 (Kayes)
4,928,775 (Lee)
4,938,297 (Schmidt)
4,958,689 (Lee)
5,002,137 (Dickinson et al.)
5,002,138 (Smet)
5,010,965 (Schmelzer)
5,031,706 (Spektor)
5,050,686 (Jenne)
5,056,608 (Hemmings).

The typical earth-burrowing mole has a missile-like elongate body which extends along an axis and a forward head designed for earth penetration. Inside the elongate body is a percussive drive means driven by pneumatic or hydraulic pressure which builds up and is released in a repetitive pounding action.

Existing earth-burrowing mole products have numerous problems, many of which relate to a lack of control of the direction of movement through the ground. Because of this, much of the development has related to controlling boring direction of the moles as they move underground, driven by pneumatic or hydraulic pressure which operates a percussion device. Typically, flexible pneumatic (or hydraulic) supply lines are connected to the rear of the mole and are dragged by the mole into the burrow as it is formed by the mole.

Systems which have directional control seek such control primarily by directing the forward movement of the mole off-axis by imposing slant-angled surfaces against the ground through which the mole moves. Such surfaces are typically a slant tip or fins. Efforts at obtaining directional control, however, have left many problems.

The Williams et al. patent discloses a boring unit with a pair of adjustable fins mounted near the front which serve to raise and lower the direction of underground travel. However, the Williams et al. device has only limited directional control. Furthermore, the Williams et al. device does not appear to be a mole in the normal sense, that is, a generally free-running device driven by fluids (pneumatic or hydraulic). Instead, it appears to be a device pushed by rigid pusher rods using a backhoe or the like. The Williams et al. device is not concerned with steering in the normal sense, that is, for severe course changes, but only with correction of the course of a pusher rod to an intended true horizontal direction.

Some of the patents disclose devices with adjustable fins which are located at the rear of the mole or other burrowing device. For example, the Gagen et al. patent steers by adjustment of fins to parallel planes. Stated more accurately, such patent discloses one adjustable fin which moves between a position for mole rotation and a mole-turning position parallel to the other fin.

The Gagen et al. device, with its rear fins, has considerable resistance to its attempts to change direction. This is because of the lateral resistance to turning along the length of the device. The devices of the Bridges et al. and Coyne et al. patents also have rear adjustable fins, and the same inherent disadvantage.

Among the recent developments has been a product sold by Allied under the commercial name "Guided Hole-Hog." The McDonald et al. '191 patent appears to be related to such product.

The McDonald et al. '191 patent relates to a device with a fixed-fin sleeve which is either free-wheeling or lockable and a beveled tip. As with certain other prior art devices, the beveled tip causes the mole to move off axis unless the elongate body is rotating about its axis; if it is rotated about its axis, the off-axis effect of the beveled tip is constantly experienced in different directions, which cancels out any tendency of the mole to change direction.

Such rotation of the elongate body is achieved by means of the rear fin arrangement which, when the fin sleeve is locked to the mole, causes the elongate body to rotate, thus keeping the mole on a generally straight course. On the other hand, when the fin sleeve is free-wheeling with respect to the remainder of the mole, the mole does not rotate and is driven off-axis by its tip. One embodiment in the patent is shown as having adjustable rear-mounted fins.

There are several disadvantages with the Guided Hole-Hog and other earth-burrowing moles of the prior art. Among these are the very long turning radius of mole turning, clearly insufficient turning forces which cause slow turning, the resulting inability to surface launch (as opposed to pit launch) the moles, the difficulty or impossibility of correcting a mole's direction of movement if it rotated too far, such that its beveled tip is beyond the intended turning direction, and the high cost of devices intended to solve some of the directional shortcomings.

Many earth-burrowing moles are on the market. Most either have no directional control systems or have control systems burdened with well-known disadvantages. Furthermore, to obtain a mole which has steer-ability of any sort typically requires a mole owner to discard his existing equipment and purchase a steerable unit.

In summary, there is a clear need for unique equipment overcoming the failings and disadvantages of the prior art. There is a clear need for an improved steerable mole for underground burrowing.

OBJECTS OF THE INVENTION

It is an object of this invention to provide a steerable earth-burrowing mole overcoming some of the problems and shortcomings of the prior art.

Another object of this invention is to provide a steerable mole with having a relatively short radius of mole turning.

Another object of this invention is to provide a mole with enhanced turning forces sufficient for improved turning.

Another object of this invention is to provide a steerable mole which can readily be surface launched as well as pit launched.

Another object of this invention is to provide a steerable earth-burrowing mole with the ability to correct its direction of steering, particularly from a position of over-rotation.

Another object of this invention is to provide a steerable mole which is economical.

Still another object of this invention is to provide an adaptor for standard earth-burrowing moles to make them steerable.

These and other important objects will be apparent from the descriptions of this invention which follow.

SUMMARY OF THE INVENTION

This invention is an improved steerable mole for use in earth burrowing and an adaptor for converting standard moles (or steerable moles) into improved steerable moles. The earth-burrowing mole of this invention is of the type having an elongate axial body, a forward tip for earth penetration, percussive drive means within the body, and a steering means.

The mole of this invention includes: a tip-adjacent forward steering unit which has an axially-aligned main portion and adjustable fins secured to the main portion at locations spaced about the axis; and means to adjust the fins between first and second angular orientations. The first fin orientations are such that the fins induce rotation of the elongate body in a first rotational direction about its axis during forward mole movement. The second fin orientations are such that the fins induce movement toward a first radial direction during forward mole movement.

In certain preferred embodiments, two fins are secured to the main portion at positions on opposite sides of the plane which is defined by the axis and the first radial direction. In their second orientations such two fins are substantially symmetrical about such plane.

In certain highly preferred embodiments, another of the fins secured to the main portion is at a position along the first radial direction, and such fin, in its second orientation, is aligned substantially in the aforementioned plane.

In such embodiment, such fin, while substantially aligned in such plane, is most preferably off-plane to some extent in an orientation which is such that, during forward mole movement, it induces slight rotation of the elongate body in a second rotational direction opposite the aforementioned first rotational direction. This serves to provide a highly useful rotation corrective capability.

With this important feature, if the mole has rotated to a rotational position beyond that intended, it becomes unnecessary to go through nearly a full rotation of the mole in order to reach the desired rotational position—which, of course, would otherwise be necessary in order to steer in an intended direction. Instead, a short distance of further forward travel will allow return rotation, because of the second orientation of such fin. Of course, if more rotation in the first rotational direction is required, this can easily be achieved by returning all fins to or toward their first orientations, which cause rotation in such first rotational direction.

The burrowing mole of this invention preferably has a forward tip with a beveled surface facing toward the radial direction which is opposite the first radial direction. During forward mole movement with the fins in their second orientations, the beveled tip cooperates with the fins in causing strong off-axis movement toward the first radial direction. However, with the fins in their first orientations, inducing a rotational movement of the elongate body around its axis, the off-axis effect of the beveled surface of the tip is constantly changing direction and cancels itself so that there is essentially no net off-axis movement.

In preferred embodiments, the fin-adjustment means involves a unique and beneficial structure of the forward steering unit. The main portion of the forward steering unit forms an axial bore and a plurality of radial bores intersecting the axial bore, and each of the fins has a shaft affixed to it which is rotatably received within one of the radial bores, allowing rotational movement of the fins within certain limits. Each such shaft member has a distal portion extending into the axial bore, and each such distal portion has first and second lands which are engageable from opposite axial directions. Thus, considering the plurality of fins, there is a set of first lands facing one general direction within the axial bore and a set of second lands generally facing the opposite direction within the axial bore.

Pushing means within the axial bore serve(s) to push the set of first lands and the set of second lands in opposite axial directions. The first lands and the second lands are angled transverse to the axis of the elongate body in a manner such that pushing them rotates the shafts to move the fins toward the first and second angular orientations, respectively.

The pushing means preferably includes a piston which is slidably received within the axial bore and has at least one axial face engageable with one of the sets of lands to push them in one axial direction. The pushing means further preferably includes hydraulic means to urge the piston in such axial direction.

In highly preferred embodiments, the pushing means further includes spring means to push the other set of lands in the opposite axial direction. Such spring means most preferably is a resilient compressible mass. Such compressible mass may be forced one direction by hydraulic pressure acting through the piston, and then releases in the opposite direction to push the other set of lands, as noted.

In the most highly preferred embodiments, the piston has an annular groove into which the shaft member distal portions extend, such groove having opposed first and second axial faces which are engageable with the first lands and the second lands, respectively. Hydraulic pressure urges the piston in one axial direction such that the first axial face of the groove engages and pushes the first lands, and thereby rotates the shafts to move the fins toward the first angular orientations. Spring means urges the piston in the opposite axial direction such that the second axial face engages and pushes the second lands, and thereby rotates the shafts to move the fins toward the second angular orientations.

This invention is also an adaptor for converting a basic burrowing mole into a steerable mole. The basic burrowing moles which may be converted are moles of the type with an elongate body extending along an axis, a front end, a rear end, and percussive drive means.

The adaptor of this invention includes a forward steering unit having an axially-aligned main portion, adjustable fins secured thereto about the axis, an earth-penetrating tip, and a proximal end engageable with the front end; means to secure the forward steering unit to the basic mole with the front end of the basic mole and the proximal end of the forward steering unit engaged; and means to adjust the fins between first and second angular orientations as described above.

In preferred embodiments, the securing means has a rearward unit which is engageable with the rear end of the basic mole and connector rods which extend between the forward steering unit and the rearward unit to sandwich the basic mole between such units.

A highly preferred embodiment includes a tubular casing which extends between the rearward unit and the forward steering unit and serves to enclose the basic mole and the connector rods, and an hydraulic line to power the adjustment of the fins, such line extending inside the casing from the rearward unit to the forward steering unit.

In the most highly preferred embodiment of the adaptor of this invention, the tip has a beveled surface facing toward a radial direction which is opposite the first radial direction. As earlier note, such beveled tip, during forward mole movement, cooperates with the fins to cause strong movement toward the first radial direction.

The burrowing mole of this invention exhibits superior performance, particularly with respect to steering capability. The adaptor of this invention may be used to convert a wide variety of moles into guided moles with such superior performance.

DETAILED DESCRIPTIONS OF PREFERRED EMBODIMENTS

Figure 1:
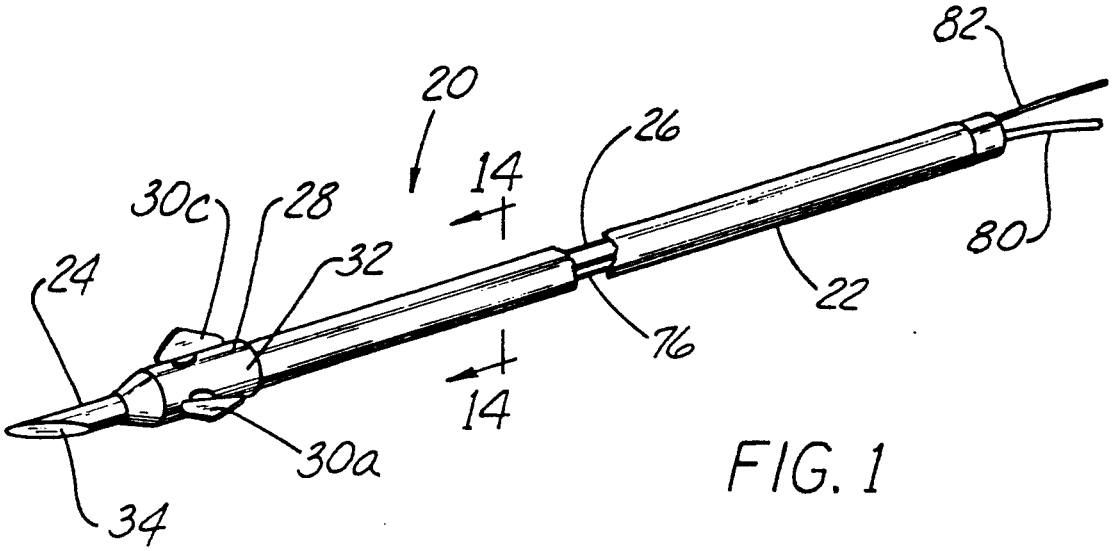
FIG. 1 is a reduced perspective view of the burrowing mole of this invention, partially broken away to show certain inside parts.
Figure 2:
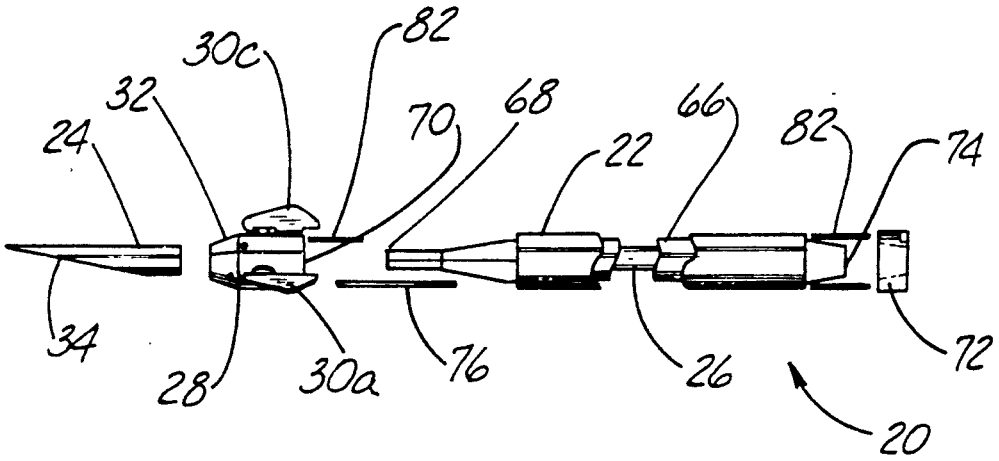
FIG. 2 is a partially exploded side elevation of FIG. 1.
Figure 3:
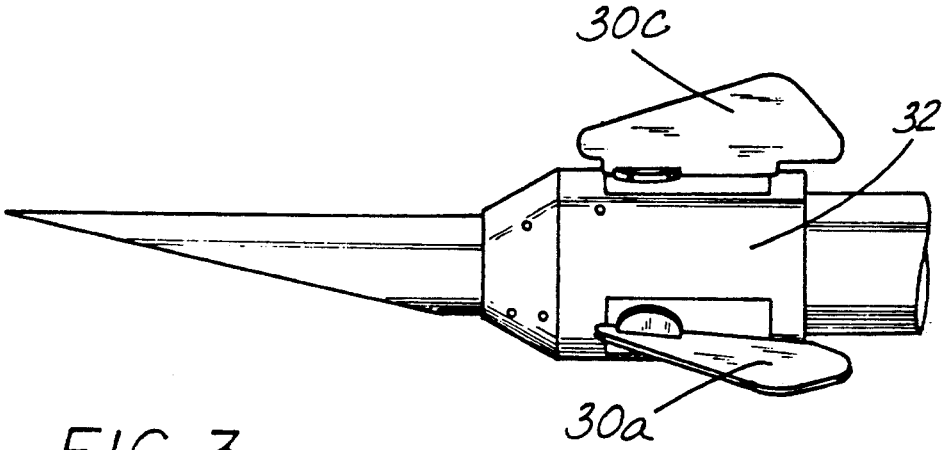
FIG. 3 is an enlarged perspective of a portion of FIG. 1.

FIGS. 1 and 2 show a burrowing mole 20 according to this invention. Mole 20 has an elongate body 22 extending along an axis, a forward earth-penetrating tip 24, a percussive drive means 26 which is shown in FIG. 14 and the break-away portions of FIG. 1, and a forward steering unit 28 adjacent to tip 24. Steering unit 28 is shown in greater detail in FIGS. 3–13.

Steering unit 28 includes an axially-aligned main portion 32 and three fins 30*a–c* secured to it. Fins 30*a–c* are adjustable with respect to main portion 32 between first and second angular orientations, the first shown in FIGS. 4 and 12 and the second shown in FIGS. 1, 2, 5 and 13. Main portion 32 is in a permanent fixed position with respect to elongate body 22; that is, it neither rotates nor moves axially with respect to body 22. When fins 30*a–c* are in their second orientations, as illustrated best in FIG. 5, mole 20 moves in a first radial direction indicated by arrow A in FIG. 5. A principal reference plane is defined by the axis of elongate body 22 and such first radial direction.

Figure 4:
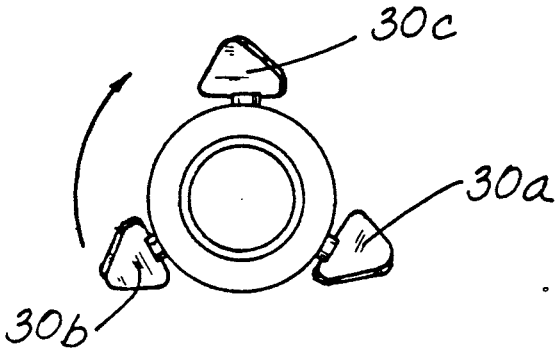
FIGS. 4 and 5 are left elevations of FIG. 3, showing, however, the device with its fins in two different orientations.

The first orientations of fins 30, best shown in FIG. 4, are set at angles of about 20° with respect to the radial planes extending from the axis of elongate body 22. Each of the fins is angled in the same manner, such that together they cause mole 20 to rotate in a first rotational direction illustrated by the curved arrow in FIG. 4.

Figure 5:
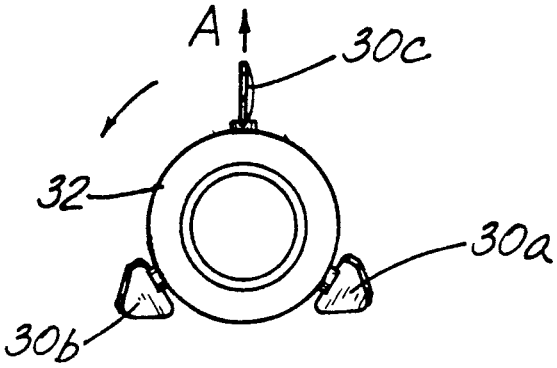
Figure 6:
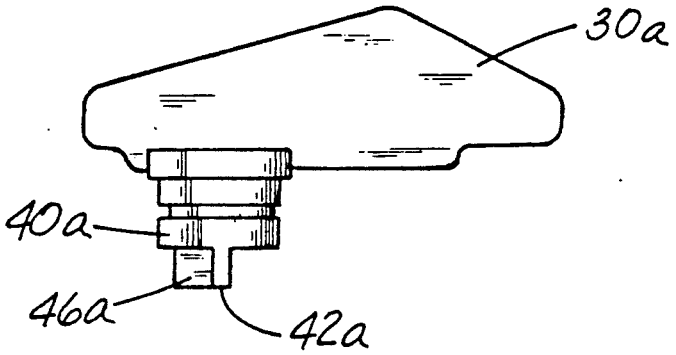
FIG. 6 is an enlarged elevation of one of the fins along with a shaft affixed thereto.
Figure 7:
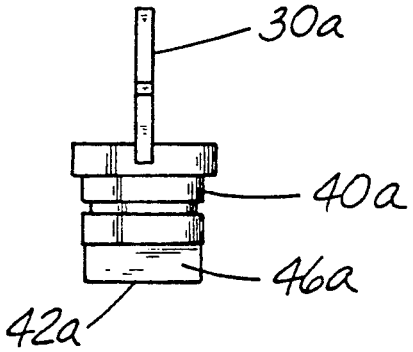
FIG. 7 is a left side elevation of FIG. 6.
Figure 8:
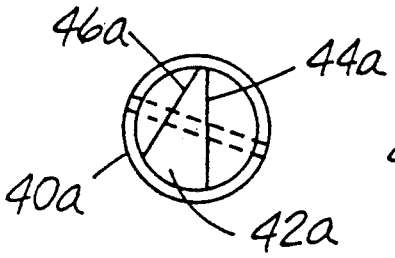
FIG. 8 is a bottom elevation of FIG. 6, but showing only the shaft and its distal end portion, the fin itself being removed.
Figure 9:
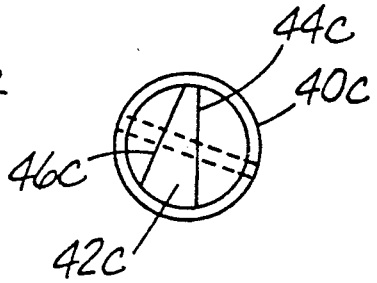
FIGS. 9 and 10 are shaft end views as in FIG. 8, but illustrating the shafts of the two other fins of the device illustrated.
Figure 10:
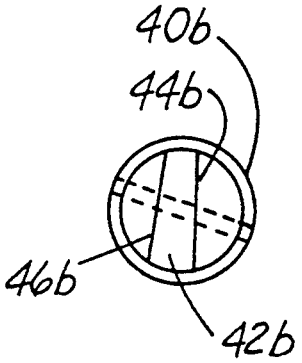

The second orientations of fins 30, best shown in FIG. 5, are changed from the orientations of FIG. 4. Fin 30*a* has moved from a 20° angle with respect to a radial plane to about a 12 angle on the other side of such radial plane. Fin 30*b* has rotated from a 20° angle to a 12° angle on the same side of a radial plane. Thus, fins 30*a* and 30*b*, which are secured to main portion 32 at positions on opposite sides of the principal reference plane mentioned above, are substantially symmetrical about such plane when in their second orientations.

Fin 30*c*, in its second orientation, has rotated from a 20° angle with respect to a radial plane to a position substantially aligned in the principal reference plane. However, fin 30*c* is actually off-plane by about 2°, that is, at a position 2° beyond such plane. During forward movement of mole 20, this orientation induces a slight rotation of mole 20 in a second rotational direction which is opposite the first rotational direction. The second rotational direction is illustrated by the curved arrow in FIG. 5.

Such slight return rotation provides a rotation corrective capability which, as noted above, avoids the need for a full rotation to establish an intended direction if the intended direction was over-shot before a change in mole direction was started.

Tip 24 is affixed, both axially and rotationally with respect to main portion 32; that is, it moves neither axially nor rotationally with respect to main portion 32. Tip 24 has a beveled surface 34 facing toward the radial direction opposite the first radial direction referred to above.

When fins 30*a*, 30*b* and 30*c* are in their second orientations, as illustrated in FIG. 5, beveled surface 34 cooperates with fins 30*a* and 30*b* to provide a strong lateral movement toward the first radial direction. These cooperative turning forces give the burrowing mole of this invention an unequaled turning capability. All of such forces are applied at the forward end of mole 20.

Figure 11:
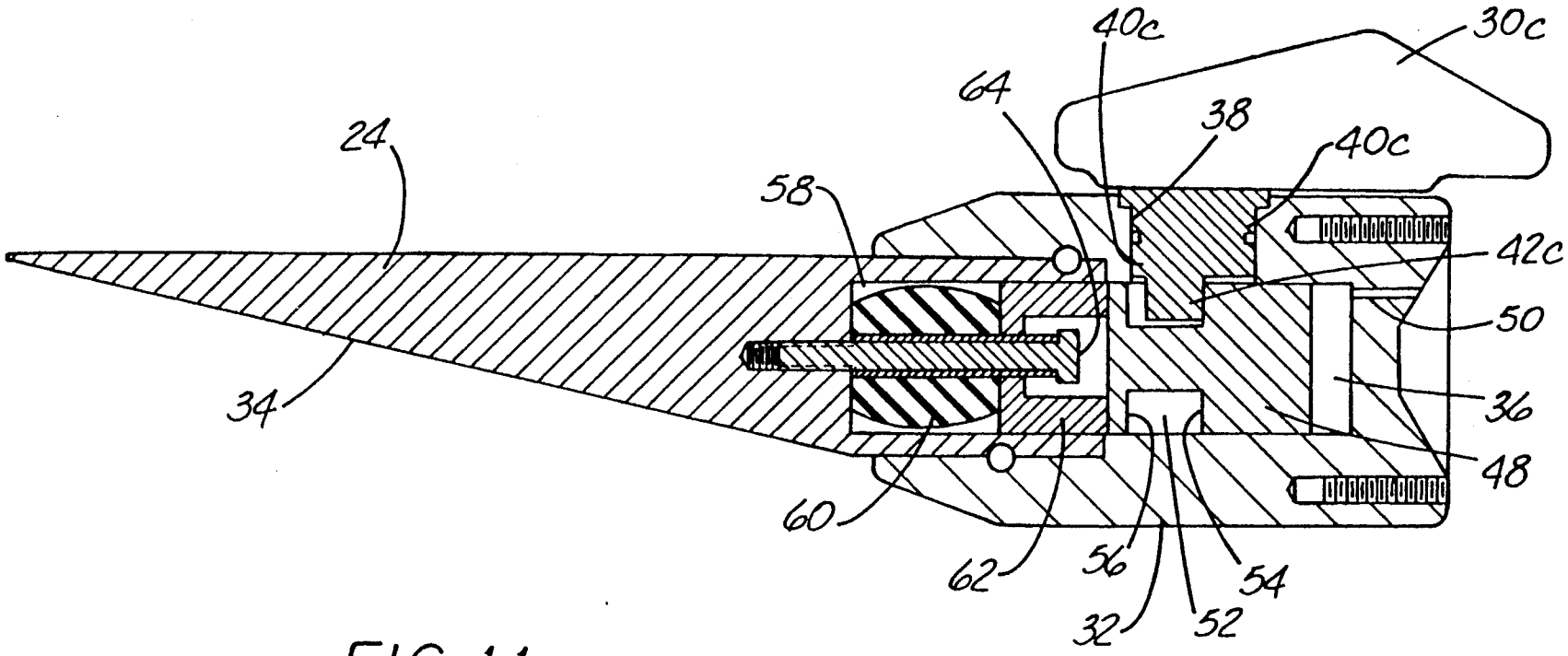
FIG. 11 is an enlarged side sectional of the tip and forward steering unit of the burrowing mole of this invention.

FIGS. 6–13 illustrate the means used to adjust fins 30*a*, 30*b* and 30*c*. Referring now to FIG. 11, main portion 32 forms an axial bore 36 and a plurality of radial bores 38, one of such bores being shown. Radial bores 38 intersect axial bore 36. Each of the fins 30*a–c* has a shaft 40, shaft 40*c* being illustrated in FIGS. 9 and 11–13, shaft 40*a* being illustrated in FIGS. 6–8, and shaft 40*b* being illustrated in FIG. 10. Shafts 40*a–c* are rotatably received within their respective radial bores 38.

Shafts 40*a–c* connected to fins 30*a–c* have distal portions 42*a–c*, respectively, which extend into axial bore 36. Shaft member distal portions 42*a–c* have first lands 44*a–c*, respectively, and second lands 46*a–c*, respectively These are illustrated in FIGS. 6–10.

Lands 44*a–c* and 46*a–c* are angled such that, when engaged and pressed in a direction along the axis of elongate body 22, they cause sufficient rotation of shafts 40*a–c* such that fins 30*a–c* rotate to their first and second orientations, as the case may be.

Figure 12:
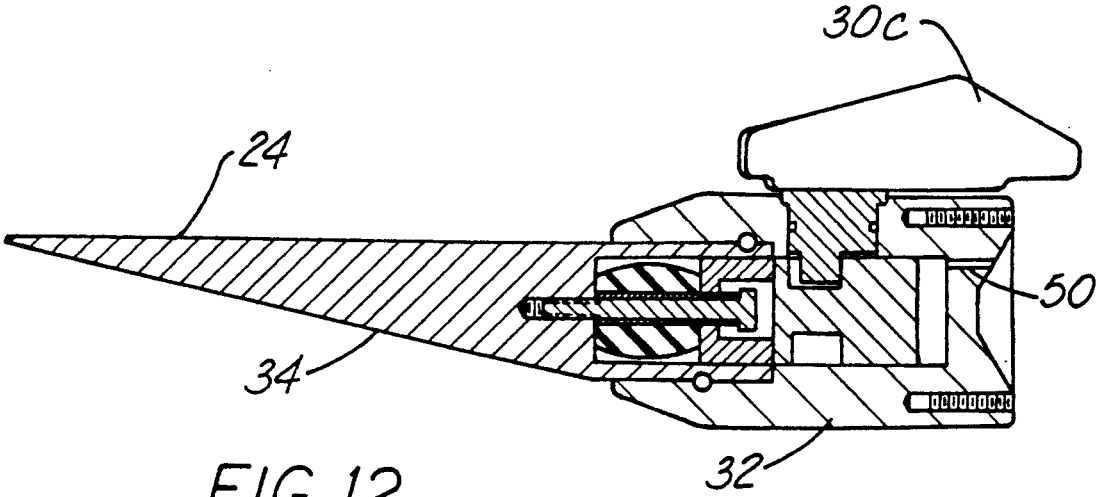
FIGS. 12 and 13 are reduced side sectionals as in FIG. 11 showing the device with the fins in their first and second angular orientations, respectively.
Figure 13:
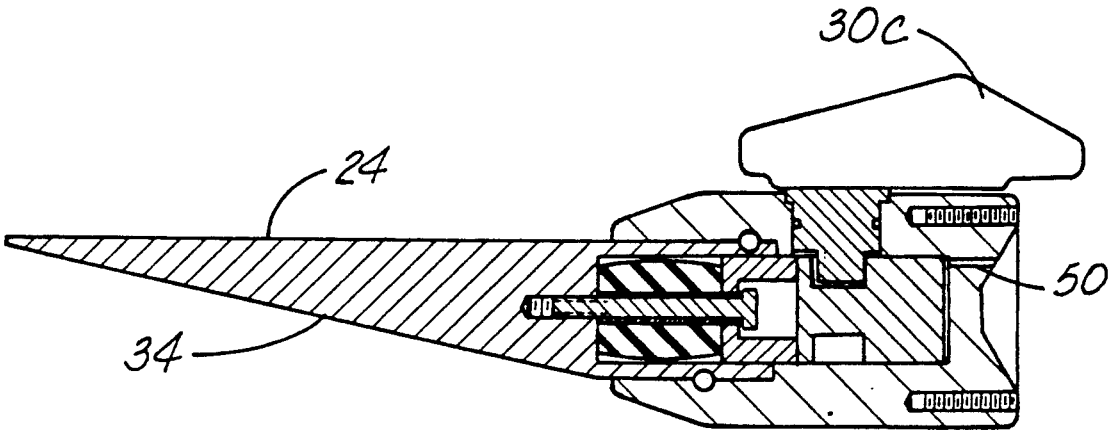
Figure 14:
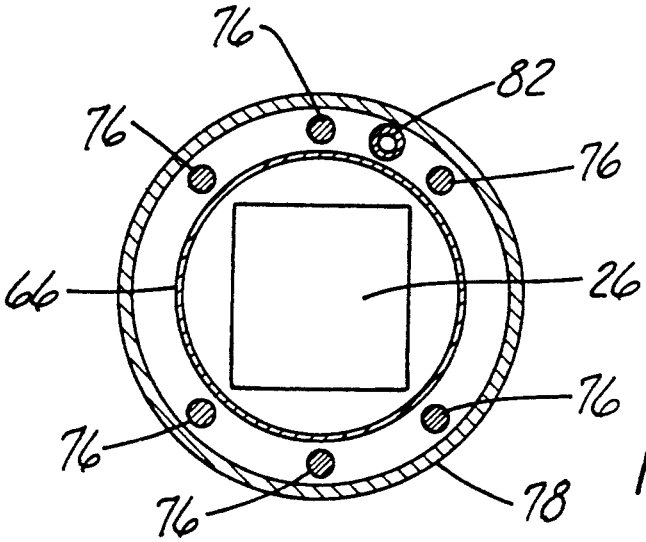
FIG. 14 is an axial partially schematic sectional view taken along section 14—14 as shown in FIG. 1.

A piston 48 is slidably received within axial bore 36 and is driven in a leftward direction, as shown in FIGS. 11–13, by hydraulic pressure entering radial bore 38 through passageway 50. Piston 48 has an annular groove 52 into which shaft member distal portions 42*a–c* extend. Annular groove 52 includes opposed first and second axial faces 54 and 56 which are engagable with first lands 44*a–c* and second lands 46*a–c*, respectively.

The introduction of hydraulic fluid through passageway 50 to the right-hand side of axial bore 36 drives piston 48 in a leftward direction such that first axial face 54 engages first lands 44*a–c* and moves such lands (that is, by in-place rotation of shafts 40*a–c*) until first lands 44*a–c* are in full surface-to-surface contact with first axial face 54 of piston 48. This displacement causes rotation of shafts 40*a–c*, and therefore, of fins 30*a–c* until they are in the first orientations, shown best in FIG. 4. When the hydraulic pressure is released, piston 48 is free to move in the rightward direction (of the figures).

Tip 24 forms a tip cavity 58, as illustrated in FIG. 11. Within tip cavity 58 is an annular resilient mass-spring 60 which is retained in tip cavity 58 by a spacer member 62 slidably received within tip cavity 58. Spacer member 62 moves between the two positions shown in FIGS. 12 and 13, either under the hydraulic pressure exerted thereon by piston 48 or under the spring pressure exerted thereon by mass-spring 60. The limits of movement of mass-spring 60 and spacer member 62 are set by means of a bolt 64 which is axially affixed to tip 24.

Mass-spring 60 is preferably a highly resilient Neoprene material. Mass-spring 60 is compressible to 40% of its original axial dimension (such compressed condition shown in FIG. 12) at which point it supplies approximately 500 psi return pressure in the rightward direction (to the right side of the figures). Such high pressure is exerted from the position shown in FIG. 12. When mass-spring 60 reaches its rightward limit, as shown in FIG. 13, it is still providing about 400 psi.

It has been found that mass-spring 60 is fully capable of exerting sufficient return pressure, through spacer member 62 and piston 48, to rotate shafts 40*a–c* and thus fins 30*a–c* to their second angular orientations as shown best in FIG. 5. Spacer member 62 pushes piston 48 such that second axial face 56 engages second lands 46*a–c* to cause such shaft rotation.

A variety of alternative designs may be used to achieve the movements referred to above. Instead of hydraulic loading in one direction and compressive-mass loading in the other, the device may have appropriate hydraulic switching means to use hydraulic pressure for piston movement in both directions. A variety of other approaches may be used as well.

The adaptor of this invention includes forward steering unit 28 as already described and means to secure such forward steering unit to a basic mole 66, such as a non-steerable mole. In such attachment, the front end 68 of basic mole 66 is secured to the proximal end 70 of forward steering unit 28. The securing means also includes a rearward unit 72 which is engagable with the rear end 74 of basic mole 66. Six connector rods 76, some of which are shown in FIG. 1 and all of which are illustrated in FIG. 14, sandwich basic mole 66 between forward steering unit 28 and rearward unit 72.

Connector rods 76, along with basic mole 66, are contained within a tubular casing 78, illustrated in FIGS. 1–3 and 14. FIG. 14 also shows schematically the position of percussive drive means 26, contained within basic mole 66. Details of percussive drive means 26 need not be described. Numerous such drive means are well known to those skilled in the art.

As shown best in FIG. 1, a flexible pneumatic supply line 80 extends to rearward unit 72 and from there to basic mole 66 within casing 78. Likewise, hydraulic supply line 82 (see FIG. 14) extends to rearward unit 72 and within casing 78 to forward steering unit 28 in order to provide the hydraulic pressure necessary for operation of the steering device. For clarity, FIG. 2 and the cut-away portion of FIG. 1 only partially show connector rods 76 and hydraulic supply line 82.

The parts of burrowing mole 20 are made with hardened steel as is common for earth-burrowing moles. Many variations of materials are possible, and are well known to those skilled in the art.

While the principles of this invention have been described in connection with specific embodiments, it should be understood clearly that these descriptions are made only by way of example and are not intended to limit the scope of the invention.

We claim:

1. In a burrowing mole of the type with an elongate body extending along an axis, a forward earth-penetrating tip, percussive drive means, and steering means, the improvement comprising:

the steering means being a tip-adjacent forward steering unit having an axially-aligned main portion and fins secured thereto about the axis, including at least two adjustable fins wherein the steering means facilitates three-dimensional maneuvering; and means to adjust the adjustable fins between first and second angular orientations, the first orientations for inducing rotation of the elongate body in a first rotational direction about its axis during forward mole movement and the second orientations for inducing movement toward a first radial direction during forward mole movement.

2. The device of claim 1 wherein two of the fins are secured to the main portion at positions on opposite sides of the plane defined by the axis and the first radial direction.

3. The device of claim 2 wherein said two fins, in their second orientations, are substantially symmetrical about said plane.

4. The device of claim 1 wherein the tip has a beveled surface facing toward a radial direction opposite the first radial direction, whereby during forward mole movement the tip cooperates with the fins in causing movement toward the first radial direction.

5. The device of claim 4 wherein two of the fins are secured to the main portion at positions on opposite sides of the plane defined by the axis and the first radial direction.

6. The device of claim 5 wherein said two fins, in their second orientations, are substantially symmetrical about said plane.

7. An adaptor for making a basic burrowing mole, of the type with an elongate body extending along an axis, a front end, a rear end, and percussive drive means, into a steerable mole, comprising:

a forward steering unit having an axially-aligned main portion, adjustable fins secured thereto about the axis, an earth-penetrating tip, and a proximal end engageable with the front end;

means to secure the forward steering unit to the basic mole with the front end of the basic mole and the proximal end of the forward steering unit in engagement; and means to adjust the fins between first and second angular orientations, the first orientations for inducing rotation of the elongate body in a first rotational direction about its axis during forward mole movement and the second orientations for inducing movement toward a first radial direction during forward mole movement.

8. The device of claim 7 wherein the securing means comprises:

a rearward unit engageable with the rear end of the basic mole; and connector rods extending between the forward steering unit and the rearward unit to sandwich the basic mole between such units.

9. The device of claim 8 further comprising:

a tubular casing extending between the rearward unit and the forward steering unit and to enclose the basic mole and the connector rods;

an hydraulic line to power the adjustment of the fins, said line extending inside the casing from the rearward unit to the forward steering unit.

10. The device of claim 9 wherein the tip has a beveled surface facing toward a radial direction opposite the first radial direction, whereby during forward mole movement the tip cooperates with the fins in causing movement toward the first radial direction.

11. In a burrowing mole of the type with an elongate body extending along an axis, a forward earth-penetrating tip, percussive drive means, and steering means, the improvement comprising:

the tip being beveled to apply turning force toward a first radius opposite said bevel during forward mole movement;

a tip-adjacent forward steering unit having an axially-aligned main portion and adjustable fins secured thereto about the axis; and means to adjust the fins between first and second angular orientations, the first orientations for inducing rotation of the elongate body in a first rotational direction about its axis during forward mole movement and the second orientations for inducing movement toward said first radius during forward mole movement, at least two of said fins in their second orientations and the bevel being substantially parallel; thereby providing increased turning force from at least three forward surfaces.

12. The device of claim 11 wherein two of the fins are secured to the main portion at positions on opposite sides of the plane defined by the axis and the first radius.

13. The device of claim 12 wherein said two fins, in their second orientations, are substantially symmetrical about said plane.

14. The device of claim 12 having another of the fins secured to the main portion at a position along the first radial direction, said other fin, in its second orientation, aligned substantially in said plane.

15. The device of claim 14 wherein said other fin, while substantially aligned in said plane, is off-plane in an orientation for inducing, during forward mole movement, slight rotation of the elongate body in a second rotational direction opposite the first rotational direction, thereby providing rotation corrective capability which avoids the need for a full rotation to establish an intended direction.

16. The device of claim 11 wherein the adjustment means comprises:

the main portion of the forward steering unit forming an axial bore and a plurality of radial bores intersecting the axial bore;

each of the fins having a shaft affixed thereto which is rotatably received within one of the radial bores and a shaft member distal portion extending into the axial bore, each distal portion having first and second lands engageable from opposite axial directions; and means in the axial bore to push the set of first lands and the set of second lands in opposite axial directions, the first lands and the second lands being angled such that pushing them rotates the shafts to move the fins toward the first and second angular orientations, respectively.

17. The device of claim 16 wherein the pushing means includes a piston slidably received within the axial bore, the piston having at least one axial face engageable with one of the sets of lands to push them in one axial direction.

18. The device of claim 17 wherein the pushing means further comprises hydraulic means to urge the piston in said one axial direction.

19. The device of claim 18 wherein the pushing means further comprises spring means to push the other set of lands in the opposite axial direction.

20. The device of claim 19 wherein the spring means comprises a resilient compressible mass.

21. The device of claim 17 wherein the piston has an annular groove into which the shaft member distal portions extend, the groove including opposed first and second axial faces engageable with the first lands and the second lands, respectively.

22. The device of claim 21 wherein the pushing means further comprises:

hydraulic means to urge the piston in one axial direction such that the first axial face engages and pushes the first lands and thereby rotates the shafts to move the fins toward the first angular orientations; and spring means to urge the piston in the opposite axial direction such that the second axial face engages and pushes the second lands and thereby rotates the shafts to move the fins toward the second angular orientations.

23. The device of claim 21 wherein the spring means comprises a resilient compressible mass.

24. In a burrowing mole of the type with an elongate body extending along an axis, a forward earth-penetrating tip, percussive drive means, and steering means, the improvement comprising:

a tip-adjacent forward steering unit having an axially-aligned main portion and adjustable fins secured thereto about the axis; and means to adjust the fins between first and second angular orientations, the first orientations for inducing rotation of the elongate body in a first rotational direction about its axis during forward mole movement and the second orientations for inducing movement toward a first radial direction during forward mole movement, said fins including:

two secured to the main portion at positions on opposite sides of the plane defined by the axis and the first radial direction; and another secured to the main portion at a position along the first radial direction, said other fin, in its second orientation, aligned substantially in said plane.

25. The device of claim 24 wherein said other fin, while substantially aligned in said plane, is off-plane in an orientation for inducing, during forward mole movement, slight rotation of the elongate body in a second rotational direction opposite the first rotational direction, thereby providing rotation corrective capability which avoids the need for a full rotation to establish an intended direction.

26. In a burrowing mole of the type with an elongate body extending along an axis, a forward earth-penetrating tip, percussive drive means, and steering means, the improvement comprising:

the tip being beveled to apply turning force toward a first radius opposite said bevel during forward mole movement;

a tip-adjacent forward steering unit having an axially-aligned main portion and adjustable fins secured thereto about the axis; and means to adjust the fins between first and second angular orientations, the first orientations for inducing rotation of the elongate body in a first rotational direction about its axis during forward mole movement and the second orientations for inducing movement toward said first radius during forward mole movement, said fins including:

two secured to the main portion at positions on opposite sides of the plane defined by the axis and the first radius; and another secured to the main portion at a position along the first radius, said other fin, in its second orientation, aligned substantially in said plane.

27. The device of claim 26 wherein said other fin, while substantially aligned in said plane, is off-plane in an orientation for inducing, during forward mole movement, slight rotation of the elongate body in a second rotational direction opposite the first rotational direction, thereby providing rotation corrective capability which avoids the need for a full rotation to establish an intended direction.

28. In a burrowing mole of the type with an elongate body extending along an axis, a forward earth-penetrating tip, percussive drive means, and steering means, the improvement comprising:

a tip-adjacent forward steering unit having an axially-aligned main portion and adjustable fins secured thereto about the axis; and means to adjust the fins between first and second angular orientations, the first orientations for inducing rotation of the elongate body in a first rotational direction about its axis during forward mole movement and the second orientations for inducing movement toward a first radial direction during forward mole movement, said adjustment means including:

the main portion of the forward steering unit forming an axial bore and a plurality of radial bores intersecting the axial bore;

each of the fins having a shaft affixed thereto which is rotatably received within one of the radial bores and a shaft member distal portion extending into the axial bore, each distal portion having first and second lands engageable from opposite axial directions; and means in the axial bore to push the set of first lands and the set of second lands in opposite axial directions, the first lands and the second lands being angled such that pushing them rotates the shafts to move the fins toward the first and second angular orientations, respectively.

29. The device of claim 28 wherein the pushing means includes a piston slidably received within the axial bore, the piston having at least one axial face engageable with one of the sets of lands to push them in one axial direction.

30. The device of claim 29 wherein the pushing means further comprises hydraulic means to urge the piston in said one axial direction.

31. The device of claim 30 wherein the pushing means further comprises spring means to push the other set of lands in the opposite axial direction.

32. The device of claim 31 wherein the spring means comprises a resilient compressible mass.

33. The device of claim 29 wherein the piston has an annular groove into which the shaft member distal portions extend, the groove including opposed first and second axial faces engageable with the first lands and the second lands, respectively.

34. The device of claim 33 Wherein the pushing means further comprises:

hydraulic means to urge the piston in one axial direction such that the first axial face engages and pushes the first lands and thereby rotates the shafts to move the fins toward the first angular orientations; and spring means to urge the piston in the opposite axial direction such that the second axial face engages and pushes the second lands and thereby rotates the shafts to move the fins toward the second angular orientations.

35. The device of claim 31 wherein the spring means comprises a resilient compressible mass.

* * * * *

UNITED STATES PATENT AND TRADEMARK OFFICE

CERTIFICATE OF CORRECTION

PATENT NO. : 5,255,749

DATED : October 26, 1993

INVENTOR(S) : Carl J. Bumpurs and C. Gordan Baker

It is certified that error appears in the above-indentified patent and that said Letters Patent is hereby corrected as shown below:

In column 6, line 41, change "12" to --12°--.

Col. 9,
In claim 2, line 1, before "fins", insert --adjustable--.

Col. 9,
In claim 3, line 1, before "fins,", insert --adjustable--.

Signed and Sealed this

Eighth Day of November, 1994

Bruce Lehman

*Attest:*

BRUCE LEHMAN

*Attesting Officer*

*Commissioner of Patents and Trademarks*